US005612664A

United States Patent [19]

Hilgenberg et al.

[11] Patent Number: 5,612,664

[45] Date of Patent: Mar. 18, 1997

[54] ELECTRONIC CIRCUIT

[75] Inventors: Bernd Hilgenberg, Melsungen; Klemens Haeckel, Reutlingen, both of Germany

[73] Assignee: Robert Bosch GmbH, Stuttgart, Germany

[21] Appl. No.: 308,721

[22] Filed: Sep. 19, 1994

[30] Foreign Application Priority Data

Sep. 29, 1993 [DE] Germany ..... 43 33 065.7

[51] Int. Cl.[6] ..... H01C 7/22

[52] U.S. Cl. ..... 338/295; 338/215; 323/293; 323/334

[58] Field of Search ..... 338/295, 76, 78, 338/200, 201, 179, 191, 334, 215; 307/112; 361/58; 200/52, 168; 323/293, 334, 74, 53

[56] References Cited

U.S. PATENT DOCUMENTS

| | | | |
|---|---|---|---|
| 4,016,483 | 4/1977 | Rudin | 323/74 |
| 4,364,006 | 12/1982 | Makabe et al. | 323/353 |
| 4,788,620 | 11/1988 | Scott | 361/96 |
| 5,191,279 | 3/1993 | Zommer | 323/354 |

*Primary Examiner*—Tu B. Hoang
*Attorney, Agent, or Firm*—Kenyon & Kenyon

[57] ABSTRACT

An electronic circuit in which resistors $R_0 \ldots R_{n+m}$ are coupled in series with fusible cut-outs $Q_0 \ldots Q_{n+m}$ and in which at least one fusible cut-out $Q_{n+1} \ldots Q_{n+m}$ is bridged by an additional resistor $R_{n+1}' \ldots R_{n+m}'$. Each of the fusible cut-outs $Q_0 \ldots Q_{n+m}$ can be blown from a conductive to a non-conductive state. The total conductance $Y_{total}$ of the electronic circuit can thus be adjusted by targeted blowing of individual ones of the fusible cut-outs $Q_0 \ldots Q_{n+m}$.

11 Claims, 2 Drawing Sheets

$V_{prog}$
A
$S_{prog}$
$Q_0$
$Q_1$
$Q_n$
$Q_{n+1}$
$Q_{n+2}$
$Q_{n+m}$
$R'_{n+1}$
$R'_{n+2}$
$R'_{n+m}$
$R_0$
$R_1$
$R_n$
$R_{n+1}$
$R_{n+2}$
$R_{n+m}$
B
$T_0$
$T_1$
$T_n$
$T_{n+1}$
$T_{n+2}$
$T_{n+m}$
$V_{SS}$
$A_0$
$A_1$
$A_n$
$A_{n+1}$
$A_{n+2}$
$A_{n+m}$
$X_0$
$X_1$
$X_n$
$X_{n+1}$
$X_{n+2}$
$X_{n+m}$
S
T
E
R

ELECTRONIC CIRCUIT

FIELD OF THE INVENTION

The present invention relates to a fuse-programmable electronic circuit. More specifically, the present invention relates to an electronic circuit for providing a desired resistance between two terminals by selectively blowing fusible cut-outs in the circuit.

BACKGROUND OF THE INVENTION

IC-based electronic circuits are known which have several resistors switched in parallel, each of which is switched in series with a fusible cut-out, or fuse segment, so that an adjustable resistance can be achieved by targeted blowing of individual fuse segments. Such circuits are particularly useful in those cases where a determination of a definite resistance value is possible only after final assembly of the complete integrated circuit. In order to be able to set resistance values over a broad range, resistors with very high resistance values are necessary for these electronic circuits, which resistors take up a correspondingly large amount of space on the substrate of the integrated circuit.

Another known approach is to structure the electronic circuit as a serial circuit of resistors with lower resistance values, with each resistor bridged by a fuse segment. This approach, however, results in greater circuit complexity for the fuse segments and their wiring.

SUMMARY OF THE INVENTION

The electronic circuit of the present invention comprises a plurality of series circuits in parallel with each other. Each series circuit comprises a resistor in series with a fusible cut-out, or a resistor in series with the parallel combination of a fusible cut-out and an additional resistor. The values of the resistors are advantageously selected to differ from each other, since in this way, various combinations of conductive and non-conductive fusible cut-outs yield a variety of total overall resistance values, increasing the variability of the overall resistance of the electronic circuit of the present invention. Furthermore, the resistors are advantageously formed as diffused resistors of different lengths but of the same width and depth. Doing so has the advantage that approximately the same photolithography exposure parameters can be used in the production of the different resistors. This, in turn, results in advantages with regard to mask variety, lateral diffusion and layout. In addition, there is the advantage that approximately the same contact resistances for connecting contacts are achieved.

The values of the various resistors in the circuit of the present invention are selected in accordance with a binary pattern. In other words, the difference between the total conductance of the electronic circuit when all of the fusible cut-outs are in the conductive state, and the total conductance of the electronic circuit when exactly one fusible cut-out is in the non-conductive state, is equal to a unit resistance value multiplied by a factor which is a power of two, with the power being the negated index number of the resistor in series with the one non-conductive fusible cut-out, where the resistors have are numbered consecutively from 0 up to the number of resistors minus 1. Selecting the individual resistor values in this way has the advantage that each increment of the total conductance can be selected with a step distance of the unit conductance, without a gap, between the lowest and the highest possible total conductance.

The values of the resistors in the electronic circuit of the present invention are selected so that each resistor in series with the parallel combination of a fusible cut-out and an additional resistor has the value $1/[1/(2^iR_D)+1/(mR_A)]$, each additional resistor has the value $mR_A-1/[1/(2^kR_D)+1/(mR_A)]$, and each resistor which is in series with a fusible cut-out which has no additional resistor in parallel, has the value $2^iR_D$. Selecting the resistor values in accordance with the above formulas allows a simple implementation of the binary stages. The selection of the number m of additional resistors, to the extent that $mR_A$ is approximately equal to the value of the resistor with the highest index number which is in series with a fusible cut-out which has no additional resistor in parallel, allows for advantageous dimensioning of the circuit in such a way that an optimum ratio of the additional resistors to the resistors is achieved and the resistance values of the resistors and additional resistors remain close to each other. It is therefore possible, in the circuit of the present invention, for the resistors and the additional resistors to have the same structure and similar geometric dimensions. This in turn, results in the advantage that the resistors and additional resistors, if structured as integrated resistors, demonstrate similar behavior in terms of voltage modulation, temperature dependence, and piezoelectric effects.

The electronic circuit of the present invention, thus has several advantages over prior art circuits. First, the circuit of the present invention requires less circuit complexity for fusible cut-outs and their wiring. Second, the circuit of the present invention can be implemented with resistors with low resistance values while achieving an adjustable total resistance with great variability.

An advantageous refinement of the circuit of the present invention includes connecting the fusible cut-outs to a current or voltage source by means of switches. Simple programming of the fusible cut-outs between the conductive and the non-conductive states can be achieved by means of the switch positions, and only a single current or voltage source is required.

A further advantageous refinement of the circuit of the present invention includes structuring the switches as thyristors. Said thyristors can be integrated and are not subject to wear or aging effects. Control of the thyristors via outputs of a shift register has the further advantage that only a single input for serial entry of the programming data bit pattern is required for parallel control. In other words, only one pin is needed to control all of the thyristors, which is particularly advantageous in integrated circuits that are already assembled.

The implementation of the electronic circuit of the present invention in an integrated circuit offers the advantage of integrating the circuit jointly with other circuits on one semiconductor substrate, thereby minimizing production cost and complexity. In addition, temperature-related effects, for example, which can affect the electronic circuit and the other circuits in a similar manner, can be compensated for.

The electronic circuit of the present invention can particularly be used for ohmic resistors, since the space problem is reduced for these by the electronic circuit, and the behavior of the resistors relative to each other—particularly with regards to dependence on temperature and piezoelectric effects, as well as voltage modulation caused by the inherent stress of the substrate—is improved.

DETAILED DESCRIPTION OF THE DRAWINGS

Figure 1:
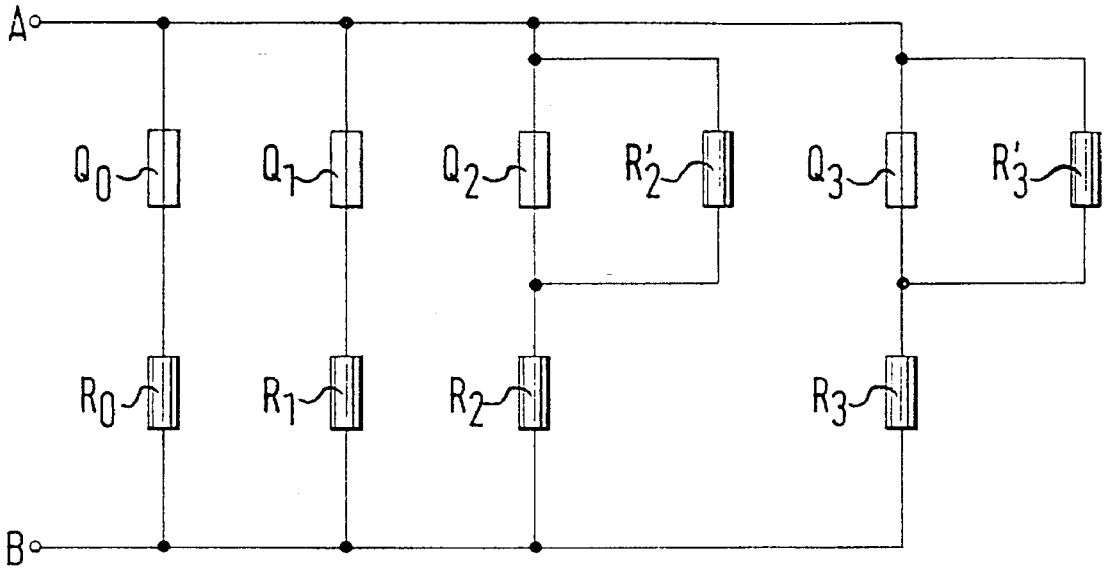
FIG. 1 shows an embodiment of the electronic circuit of the present invention with four resistors.

In FIG. 1, a first embodiment of the electronic circuit of the present invention is shown. A first series circuit that includes a first fusible cut-out $Q_0$ and a first resistor $R_0$ is connected between two terminals A and B. A second series circuit that includes a second resistor $R_1$ and a second fusible cut-out $Q_1$ is arranged in parallel with the first series circuit. A third series circuit with a third fusible cut-out $Q_2$ and a third resistor $R_2$ as well as a fourth series circuit with a fourth resistor $R_3$ and a fourth fusible cut-out $Q_3$ are further included in parallel across the terminals A and B. The third fusible cut-out $Q_2$ is bridged by a first additional resistor $R_2'$. Likewise, the fourth fusible cut-out $Q_3$ is bridged by a second additional resistor $R_3'$.

The circuit of FIG. 1 can be implemented particularly as an integrated circuit, where different values for the total conductance $Y_{total}$ between the terminals A and B can be adjusted by targeted blowing of the individual fusible cut-outs $Q_0$, $Q_1$, $Q_2$, and $Q_3$. Circuits of this type are particularly useful where exact setting of a conductance or a resistance is not yet possible at the time of designing or building the circuit. For integrated circuits which are surrounded by a housing, setting of a resistance can take place even after assembly in the housing, by targeted blowing of the individual fusible cut-outs $Q_0$, $Q_1$, $Q_2$, and $Q_3$. Thus, circuits which are influenced by the housing, for example, can be adjusted in such a way that the influence of the housing is compensated for or minimized.

Figure 2:
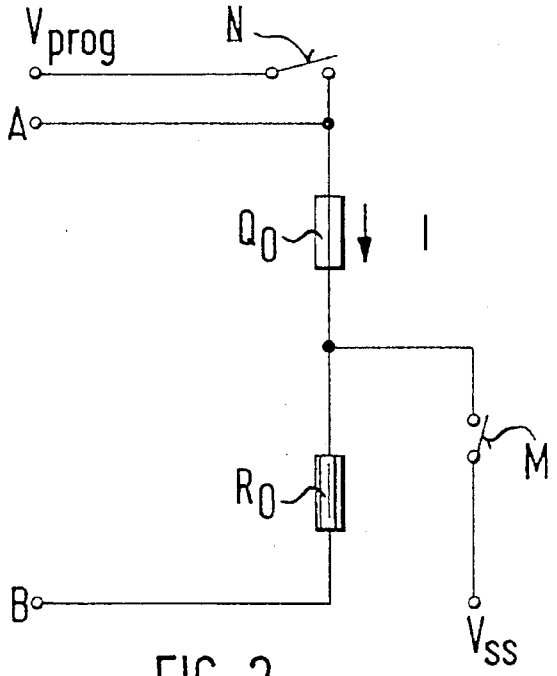
FIG. 2 shows another embodiment of the electronic circuit of the present invention with one resistor and two switches.

FIG. 2 shows a schematic representation of an electronic circuit, in accordance with the present invention, with two switches. A series circuit consisting of a first fusible cut-out $Q_0$ and a first resistor $R_0$ is connected between the terminals A and B. In addition, the terminal A is selectively coupled to a positive programming voltage $V_{prog}$ via a first switch N, while the common connection of the fusible cut-out $Q_0$ and the resistor $R_0$ is selectively coupled to a negative operating potential $V_{SS}$ via a second switch M.

By closing the second switch M and the first switch N, a current path from the positive programming potential $V_{prog}$ to the negative operating potential $V_{SS}$ is produced over the first fusible cut-out $Q_0$. The large current I which flows in this instance causes the first fusible cut-out $Q_0$ to blow, thus interrupting the current path between the terminals A and B. By closing the switches M and N, a resistance change between the terminals A and B is therefore caused.

For the integrated form of the circuit of FIG. 2, provision is made to first activate the second switch M and then to activate the first switch N, in order to make switch activations of the second switch M ineffective before the desired programming process. Only by closing the first switch N, does the switch position of the second switch M, at that time, become relevant for programming.

Figure 3:
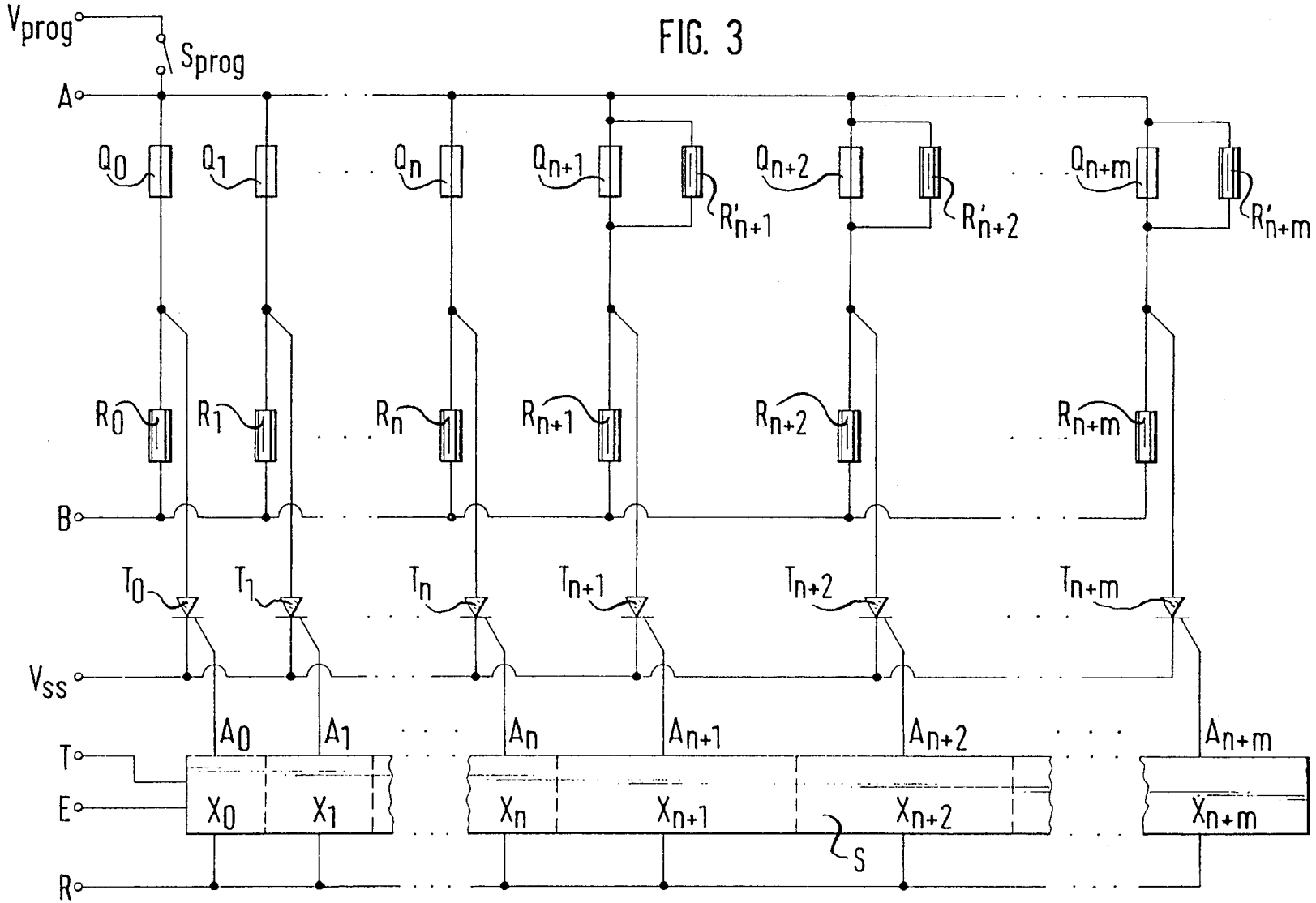
FIG. 3 shows a further embodiment of the electronic circuit of the present invention with thyristors and a shift register.

FIG. 3 shows an electronic circuit, in accordance with the present invention, with terminals A and B, between which is connected a first series circuit with a first fusible cut-out $Q_0$ and a first resistor $R_0$. Parallel to the first series circuit, additional series circuits follow, each with a fusible cut-out $Q_1 \ldots Q_{n+m}$, and each with a resistor $R_1 \ldots R_{n+m}$. Furthermore, m of the n+m fusible cut-outs, i.e., $Q_{n+1} \ldots Q_{n+m}$, each have an additional resistor $R_{n+1}' \ldots R_{n+m}'$ in parallel. Also, in each of the series circuits, a connection to a thyristor $T_0 \ldots T_{n+m}$ branches off from each of the nodes between the fusible cut-outs $Q_0 \ldots Q_{n+m}$ and the resistors $R_0 \ldots R_{n+m}$. The cathodes of the thyristors $T_0 \ldots T_{n+m}$ are connected to the negative operating potential $V_{SS}$.

A programming switch $S_{prog}$ is arranged between the positive programming potential $V_{prog}$ and the terminal A. The circuit of FIG. 3 further includes a shift register S having a data input E, a clock input T, and reset inputs $X_0 \ldots X_{n+m}$. The shift register S has n+m+1 stages, the outputs $A_0 \ldots A_{n+m}$ of which are each coupled to control inputs of the thyristors $T_0 \ldots T_{n+m}$. A reset line R is coupled to each of the reset inputs $X_0 \ldots X_{n+m}$.

To set programming in the form of a specific sequence of fusible cut-outs $Q_0 \ldots Q_{n+m}$ which are to be in the conductive or non-conductive state, a bit pattern applied to the data input E, is clocked, via the clock input T, into the shift register S while the programming switch $S_{prog}$ is still open. At the beginning of this shift process, a reset pulse is applied, via the reset input R, to all of the reset inputs $X_0 \ldots X_{n+m}$ of the shift register S. The reset pulse resets the contents of the entire shift register S to logic 0, which in turn causes all of the thyristors $T_0 \ldots T_{n+m}$ to be in the locked state.

After the input bit pattern has been shifted into the shift register S, the programming switch $S_{prog}$ is closed and the programming potential $V_{prog}$ is applied to the terminal A. By means of the programming voltage $V_{prog}$, and of the bit pattern in the shift register S, each of the thyristors $T_0 \ldots T_{n+m}$ to which a logic 1 is applied by one of the shift register outputs $A_0 \ldots A_{n+m}$, goes into a conductive state. Conductive paths between the positive programming potential $V_{prog}$ and the negative operating potential $V_{SS}$, are thus created via those fusible cut-outs $Q_0 \ldots Q_{n+m}$ for which the associated thyristor $T_0 \ldots T_{n+m}$ has been put into a conductive state by the bit pattern shifted into the shift register S. The fusing current which flows through each such conductive path causes the associated fusible cut-out $Q_0 \ldots Q_{n+m}$ to blow. To avoid overhead firing, provision is made to bring the programming voltage $V_{prog}$ up to its maximum value slowly.

In order to make possible an exact setting of the total conductance $Y_{total}$ between the terminals A and B, the values of the resistors $R_0 \ldots R_{n+m}$ are selected so that each of the resistors $R_0 \ldots R_n$ which is switched in series with a fusible cut-out $Q_0 \ldots Q_n$ which is not bridged by an additional resistor $R_{n+1}' \ldots R_{n+m}'$, has the value $2^i R_D$. Each of the remaining resistors $R_{n+1} \ldots R_{n+m}$, has the value $1/[1/(2^i R_D)+1/(mR_A)]$. In this connection i is the index number of the respective resistor, starting from 0 up to the number of the resistors $R_0 \ldots R_{n+m}$ minus 1 (i.e., i=0 to n+m). Each of the additional resistors $R_{n+1}' \ldots R_{n+m}'$ has the value $1/[1/(mR_A-2^i R_D)+1/(mR_A)]$, where m is the number of additional resistors $R_{n+1}' \ldots R_{n+m}'$.

By selecting the values of the resistors in accordance with the above formulas, it is guaranteed that the minimum limit value $Y_{min}$ for the total conductance $Y_{total}$ between the terminals A and B is equal to the reciprocal value of $R_A$. The maximum achievable limit value $Y_{max}$ for the total conductance $Y_{total}$ is $1/R_A+2/R_D$ with an infinite number of series circuits.

By predetermining the desired values for the maximum achievable limit value $Y_{max}$ and the minimum achievable limit value $Y_{min}$, as well as the desired maximum circuit complexity, in terms of the number of series circuits n+m+1, the values for $R_A$, $R_D$, and n+m are therefore established. In addition, the total conductance $Y_{total}$ changes by the value of $(2^iR_D)^{-1}$ when the fusible cut-out $Q_i$ is blown. An optimization of the ratio of n to m is preferably obtained with the values of n and m at which the highest index numbered resistor $R_0 \ldots R_n$ that is in series with a fusible cut-out $Q_0 \ldots Q_n$ which is not in parallel with an additional resistor $R_{n+1}' \ldots R_{n+m}'$, has a value equal to $mR_A$.

With ohmic diffused resistors, a layout of the circuit of the present invention can be achieved by means of optimization, where the values of the resistors $R_0 \ldots R_{n+m}$ and the additional resistors $R_{n+1}' \ldots R_{n+m}'$ are of approximately the same order of magnitude, thus making it possible to select an identical structure for the resistors $R_0 \ldots R_{n+m}$ and the additional resistors $R_{n+1}' \ldots R_{n+m}'$, with regards to width and depth, and to achieve different values merely by varying the lengths of the resistors. This makes the behavior of the resistors $R_0 \ldots R_{n+m}$ and the additional resistors $R_{n+1}' \ldots R_{n+m}'$ approximately identical, which is advantageous for the design of the circuit. The same circuit principle can also be used for complex resistors, in other words capacitors or inductors.

An example of the area of use of the electronic circuit of the present invention is in an integrated pressure sensor.

What is claimed is:

1. An electronic circuit comprising:

a plurality of series circuits coupled in parallel, each series circuit including at least one resistor coupled to at least one fusible cut-out via a signal path, wherein the signal path is interrupted by application of a fusing current to the fusible cut-out, the fusing current being sufficient to cause the fusible cut-out to transition to a non-conductive state;

at least one additional resistor coupled in parallel with at least one of the fusible cut-outs;

at least one current or voltage source coupled to each of the fusible cut-outs via at least one connection line;

at least one switch disposed in the connection line of each fusible cut-out, the switch switching the fusing current on and off; and a shift register coupled to each switch, wherein each switch is under the control of an output of the shift register.

2. The electronic circuit according to claim 1, wherein the resistors have different values.

3. The electronic circuit according to claim 1, wherein each switch is a thyristor.

4. The electronic circuit according to claim 1, wherein the resistors and the at least one additional resistor are dimensioned so that a first total conductance of the electronic circuit when all of the fusible cut-outs are in a conductive state differs from a second total conductance of the electronic circuit when exactly one fusible cut-out is in a non-conductive state, by a resistance value equal to a power of two times a unit resistance value.

5. The electronic circuit according to claim 1, wherein the electronic circuit is an integrated circuit.

6. The electronic circuit according to claim 1, wherein the resistors and the at least one additional resistor are ohmic resistors.

7. The electronic circuit according to claim 5, wherein the resistors and the at least one additional resistor are diffused resistors and differ among each other only in length.

8. An electronic circuit comprising:

a plurality of series circuits coupled in parallel, each series circuit including at least one resistor coupled to at least one fusible cut-out via a signal path, wherein the signal path is interrupted by application of a fusing current to the fusible cut-out, the fusing current being sufficient to cause the fusible cut-out to transition to a non-conductive state;

at least one additional resistor coupled in parallel with at least one of the fusible cut-outs;

wherein the resistors and the at least one additional resistor are dimensioned so that a first total conductance of the electronic circuit when all of the fusible cut-outs are in a conductive state differs from a second total conductance of the electronic circuit when exactly one fusible cut-out is in a non-conductive state by a resistance value equal to a power of two times a unit resistance value; and wherein:

a) the at least one resistor corresponding to the at least one fusible cut-out in parallel with the at least one additional resistor has a value of $1/[1/(2^iR_D)+1/(mR_A)]$, where i is an index number of the at least one resistor, m is a total number of additional resistors, $R_D$ is the unit resistance value, and $R_A$ is a total resistance of the electronic circuit when all of the fusible cut-outs are in the non-conductive state;

b) the at least one additional resistor has a value of $(mR_A)-1/[\frac{1}{2}^kR_D)+1/(mR_A)]$, where k is an index number of the resistor corresponding to the at least one additional resistor; and c) each of the resistors corresponding to a fusible cut-out having no additional resistor in parallel has a value of $2^iR_D$.

9. The electronic circuit according to claim 8, wherein m, the number of additional resistors, is such that the quantity $mR_A$ is approximately equal to the value of the resistor with a highest index number which corresponds to a fusible cut-out having no additional resistor in parallel.

10. The electronic circuit according to claim 8, wherein the electronic circuit is an integrated circuit.

11. The electronic circuit according to claim 8, wherein the resistors and at least one additional resistor are diffused resistors and differ among each other only in length.

* * * * *